US010280702B2

(12) United States Patent
Graf et al.

(10) Patent No.: US 10,280,702 B2
(45) Date of Patent: May 7, 2019

(54) MULTISTAGE HIGH PRESSURE FRACTURING SYSTEM WITH COUNTING SYSTEM

(71) Applicant: COMPLETIONS RESEARCH AG, Lucerne (CH)

(72) Inventors: Robert James Graf, Calgary (CA); Robert Steve Smolka, Calgary (CA)

(73) Assignee: COMPLETIONS RESEARCH AG, Lucerne (CH)

( * ) Notice: Subject to any disclaimer, the term of this patent is extended or adjusted under 35 U.S.C. 154(b) by 0 days.

(21) Appl. No.: 15/545,558

(22) PCT Filed: Jul. 21, 2015

(86) PCT No.: PCT/CA2015/050682
§ 371 (c)(1),
(2) Date: Jul. 21, 2017

(87) PCT Pub. No.: WO2016/115617
PCT Pub. Date: Jul. 28, 2016

(65) Prior Publication Data

US 2018/0010412 A1 Jan. 11, 2018

(30) Foreign Application Priority Data

Jan. 23, 2015 (WO) ..... PCT/CA2015/050046

(51) Int. Cl.
*E21B 23/00* (2006.01)
*E21B 33/12* (2006.01)
(Continued)

(52) U.S. Cl.
CPC ..... *E21B 33/12* (2013.01); *E21B 23/004* (2013.01); *E21B 34/063* (2013.01); *E21B 34/14* (2013.01);
(Continued)

(58) Field of Classification Search
CPC .. E21B 2034/007; E21B 23/004; E21B 33/12; E21B 34/063; E21B 34/14; E21B 43/14; E21B 43/26
See application file for complete search history.

(56) References Cited

U.S. PATENT DOCUMENTS 9,194,197 B2 * 11/2015 Smith ..... E21B 21/103
2011/0240311 A1 * 10/2011 Robison ..... E21B 23/04 166/373

(Continued)

FOREIGN PATENT DOCUMENTS

| | | |
|---|---|---|
| CA | 2764764 | 8/2012 |
| WO | WO2015/109407 | 7/2012 |
| WO | WO2012/118889 | 9/2012 |

OTHER PUBLICATIONS

PCT/CA2015/050682—PCT—International Search Report, and Written Opinion of the International Searching Authority, dated Oct. 15, 2015.

*Primary Examiner* — James G Sayre
(74) *Attorney, Agent, or Firm* — Morgan, Lewis & Bockius LLP

(57) ABSTRACT

The invention relates to a multistage high pressure fracturing system and tubular hydraulic valve (THV) system for connection to a completion string to enable isolation of a zone of interest within a well. In particular, the system enables access to a downhole formation for fracturing the zone of interest and for hydrocarbon production. The system generally includes a plug counting system, a plug capture system and a valve system wherein dropping a series of plugs down the completion string enables successive capture of individual plugs within individual THVs for subsequent fracturing operations.

18 Claims, 17 Drawing Sheets

(51) Int. Cl.

| | |
|---|---|
| ***E21B 34/00*** | (2006.01) |
| ***E21B 34/06*** | (2006.01) |
| ***E21B 34/14*** | (2006.01) |
| ***E21B 43/14*** | (2006.01) |
| ***E21B 43/26*** | (2006.01) |

(52) U.S. Cl.
CPC ..... *E21B 43/14* (2013.01); *E21B 43/26* (2013.01); *E21B 2034/007* (2013.01)

(56) References Cited

U.S. PATENT DOCUMENTS

| | | | | |
|---|---|---|---|---|
| 2013/0118732 | A1* | 5/2013 | Chauffe ..... | E21B 34/06<br>166/250.04 |
| 2013/0220603 | A1* | 8/2013 | Robison ..... | E21B 23/006<br>166/250.04 |
| 2013/0299199 | A1* | 11/2013 | Naedler ..... | E21B 43/14<br>166/386 |
| 2016/0032697 | A1* | 2/2016 | Harris ..... | E21B 43/12<br>166/373 |
| 2017/0226818 | A1* | 8/2017 | Jordan, Jr. ..... | E21B 33/12 |

* cited by examiner

MULTISTAGE HIGH PRESSURE FRACTURING SYSTEM WITH COUNTING SYSTEM

FIELD OF THE INVENTION

The invention relates to a multistage high pressure fracturing system and tubular hydraulic valve (THV) system for connection to a completion string to enable isolation of a zone of interest within a well. In particular, the system enables access to a downhole formation for fracturing the zone of interest and for hydrocarbon production. The system generally includes a plug counting system, a plug capture system and a valve system wherein dropping a series of plugs down the completion string enables successive capture of individual plugs within individual THVs for subsequent fracturing operations.

BACKGROUND OF THE INVENTION

In the oil and gas industry, during well completion operations, there is often a need to conduct different operations at various zones within the well in order to enhance production from the well. That is, within a particular well, there may be several zones of economic interest that after drilling and/or casing, the operator may wish to access the well directly and/or open the casing in order to conduct fracturing operations to promote the migration of hydrocarbons from the formation to the well for production.

In the past, there have been a number of techniques that operators have utilized in cased wells to isolate one or more zones of interest to enable access to the formation as well as to conduct fracturing operations. In the simplest situation, a cased well may simply need to be opened at an appropriate location to enable hydrocarbons to flow into the well. In this case, the casing of the well (and any associated cement) may be penetrated at the desired location such that interior of the well casing is exposed to the formation and hydrocarbons can migrate from the formation to the interior of the well.

While this basic technique has been utilized in the past, it has been generally recognized that the complexity of penetrating steel casing/cement at a desired zone is more complicated and more likely to be subject to complications than positioning specialized sections of casing adjacent a zone of interest and then opening that section after the well has been cased. Generally, if a specialized section of casing is positioned adjacent a zone of interest, various techniques can be utilized to effectively open one or more ports in a section of casing without the need to physically cut through the steel casing.

In other situations, particularly if there is a need to fracture one or more zones of the formation, systems and techniques have been developed to isolate particular sections of the well in order to both enable selective opening of specialized ports in the casing and conduct fracturing operations within a single zone.

One such technique is to incorporate packer elements and various specialized pieces equipment into one or more tubing strings, run the tubing string(s) into the well and conduct various hydraulic operations to effect opening of ports within the tubing strings.

Importantly, while these techniques have been effective, there has been a need for systems and methods that minimize the complexity of such systems. That is, any operation involving downhole equipment is expensive in terms of capital/rental cost and time required to complete such operations. Thus, to the extent that the complexity of the equipment can be reduced and/or the time/personnel required to conduct such operations, such systems can provide significant economic advantages to the operator.

In the past, such techniques of isolating sections of a well have included systems that utilize balls within a tubing string to enable successive areas of a tubing string to be isolated. In these systems, a ball is dropped/pumped down the tubing string where it may engage with specialized seats within the string and thereby seal off a lower section of the well from an upper section of the well. In the past, in order to ensure that a lower section is sealed before an upper section, a series of balls having different diameters are dropped down the tubing starting with a smallest diameter ball and progressing uphole with progressively larger balls. Typically, each ball may vary in diameter by $1/8^{th}$ of an inch and will engage with a downhole seat sized to engage with a specific diameter ball only. While effective, this system is practically limited by the range in diameters in balls. That is, to enable 16 zones of interest to be isolated, the smallest ball would be 2 inches smaller in diameter compared to the largest ball. As a result, there are practical limitations in the number of zones that can be incorporated into a tubing string which thus limits the number of zones that can be fractured. As a modern well may wish to conduct up to approximately 40 fracturing operations and possibly more than 40 fractures, current ball drop and capture systems cannot be incorporated into such wells.

Thus, there has been a need for a system that is not limited by the size of the balls being dropped and that can enable a significantly larger number of fracturing windows to be incorporated within a tubing string.

SUMMARY OF THE INVENTION

In accordance with the invention, there is provided a tubular hydraulic valve (THV) system for connection to a completion string to enable isolation of a zone of interest within a well, to enable access to a downhole formation for fracturing the zone of interest and for hydrocarbon production, the THV having an internal bore enabling a plug to pass through the THV, the THV comprising: a plug counting system having an uphole end for connection to a completion string and a plug engagement system for engagement with a plug passing through the internal bore, the plug engagement system for counting successive plugs passing through the plug counting system and for triggering a first hydraulic event when a pre-set number of plugs passing through the internal bore is reached; a plug capture system operatively connected to the plug counting system, the plug counting system responsive to the first hydraulic event to effect plug capture within the THV when the first hydraulic event is triggered; and a valve system operatively connected to the plug counting system and plug capture system, the valve system including a valve responsive to plug capture to open the valve to enable fluid flow from the internal bore to the exterior of the THV.

In one embodiment, the plug engagement system includes at least one pin connected to a tooth ratchet and a plug piston wherein engagement of a plug passing through the internal bore with the at least one pin advances the tooth ratchet a tooth distance.

In another embodiment, the tooth ratchet can be pre-set to travel a multiple of the tooth distance prior to triggering the first hydraulic event corresponding to a total number of plugs passing through the internal bore.

In one embodiment, when the tooth ratchet has travelled a pre-set distance, the plug counting system enables hydraulic fluid to pass from the internal bore to pressurize the plug piston and cause downhole movement of the plug piston.

In another embodiment, the system further includes a first hydraulic channel between the plug counting system and the plug capture system and wherein downhole movement of the plug piston opens the first hydraulic channel allowing hydraulic fluid to flow to a plug capture piston within the plug capture system and wherein the plug capture piston is responsive to the flow of hydraulic fluid through the first hydraulic channel to cause downhole movement of the plug capture piston.

In one embodiment, downhole movement of the plug capture piston narrows a portion of the internal bore within the plug capture system to prevent a plug from passing through the plug capture system.

In yet another embodiment, the system further includes a plug capture lock operatively connected to the plug capture system, the plug capture lock for engagement with the plug capture piston to prevent full uphole movement of the plug capture piston.

In one embodiment, the system may also include a valve piston and wherein when the plug capture system has retained a plug, the valve piston is exposed to hydraulic fluid within the internal bore to cause downhole movement of the valve system to open a valve.

In another embodiment, the plug counting system includes a processor and power system operatively connected to a plug engagement system and to a solenoid valve or electric motor for controlling the flow of hydraulic fluid through a hydraulic channel wherein a plug passing through the internal bore is counted by the processor and when a pre-set number of plugs are counted, the processor opens the solenoid valve thereby triggering the first hydraulic event.

In another embodiment, the plug engagement system includes at least one movable pin in operative engagement with an electrical circuit, wherein engagement of a plug with the at least one pin as the plug passes through the internal bore moves the pin and connects or disconnects the electrical circuit and sends a signal to the processor that a plug has passed. The plug engagement system may include two movable pins spaced apart longitudinally in the internal bore, each pin in operative engagement with an electrical circuit, the two pins enabling the processor to determine the direction a plug has moved in the internal bore. The two pins may be spaced apart longitudinally to enable a passing plug to disengage one of the pins before engaging the other pin. The two pins may be out of phase with each other along the internal bore.

In a further embodiment, the time between the processor determining the pre-set number of plugs have been counted and the triggering of the first hydraulic event is programmable.

In another embodiment, the invention provides a tubular hydraulic valve system for connection to a tubing string to isolate a zone of interest within a well, to access a downhole formation for fracturing the zone of interest and for hydrocarbon production, the tubular hydraulic valve system comprising: an outer sleeve having uphole and downhole connectors for attaching the tubular hydraulic valve system to a tubing string, the outer sleeve containing: a plug counting system within the outer sleeve, the plug counting system having: at least one plug interaction surface for detecting the movement of a plug past the plug counting system; and, a hydraulic activation system operable to activate a plug grab system when a pre-set number of plugs have moved past the plug counting system; wherein the plug grab system is operatively connected to the plug counting system and is responsive to the hydraulic activation system to activate a plug retention surface and thereby retain a plug within the plug grab system and seal the downhole section of the tubing string from the uphole section of the tubing string at the plug; and, a valve system operatively connected to the plug grab system, the valve system including a valve operatively connected to at least one opening in the outer sleeve and wherein the valve system is responsive to a hydraulic fluid pressure to open the valve when a plug is retained in the plug grab system.

In another aspect, the invention provides a method for activating a hydraulic valve in a completion string having a plurality of tubular hydraulic valves (THV) as in claim 1 and corresponding packer elements incorporated therein, comprising the steps of: a) pressurizing the completion string to a first pressure to set the packer elements within the well; b) increasing the pressure within the completion string to a second pressure level sufficient to effect rupture of a first shear pin within a THV; c) dropping a plug into the completion string, the plug for successive engagement with plug counting systems within each THV and wherein if engagement of a plug with a THV triggers a first hydraulic event, the first shear pin ruptures to effect plug capture within the THV and valve opening; and d) increasing the pressure within the completion string to a third pressure level to effect well fracturing.

In one embodiment, each of steps b)-d) are repeated for each THV within the completion string.

BRIEF DESCRIPTION OF THE DRAWINGS

The invention is described with reference to the accompanying figures in which:

FIG. 3B-3C and FIG. 3D-3E are cross sections of the MFD at 90° to each other, as indicated on FIG. 3A.

FIG. 4A-4B and FIG. 4C-4D are cross sections of the MFD at 90° to each other.

FIG. 7A illustrates the ball shortly after it enters the MFD. FIG. 7B illustrates the ball depressing a first pin of the electronic counting system. FIG. 7C illustrates the ball after it has passed the first pin but before it contacts a second pin. FIG.

7D illustrates the ball depressing the second pin. FIG. 7E illustrates the ball after it has passed the second pin.

DETAILED DESCRIPTION OF THE INVENTION

With reference to the figures, a multistage fracturing device (MFD) or tubular hydraulic valve (THV) 10 and methods of operating a MFD or THV are described.

Figure 1:
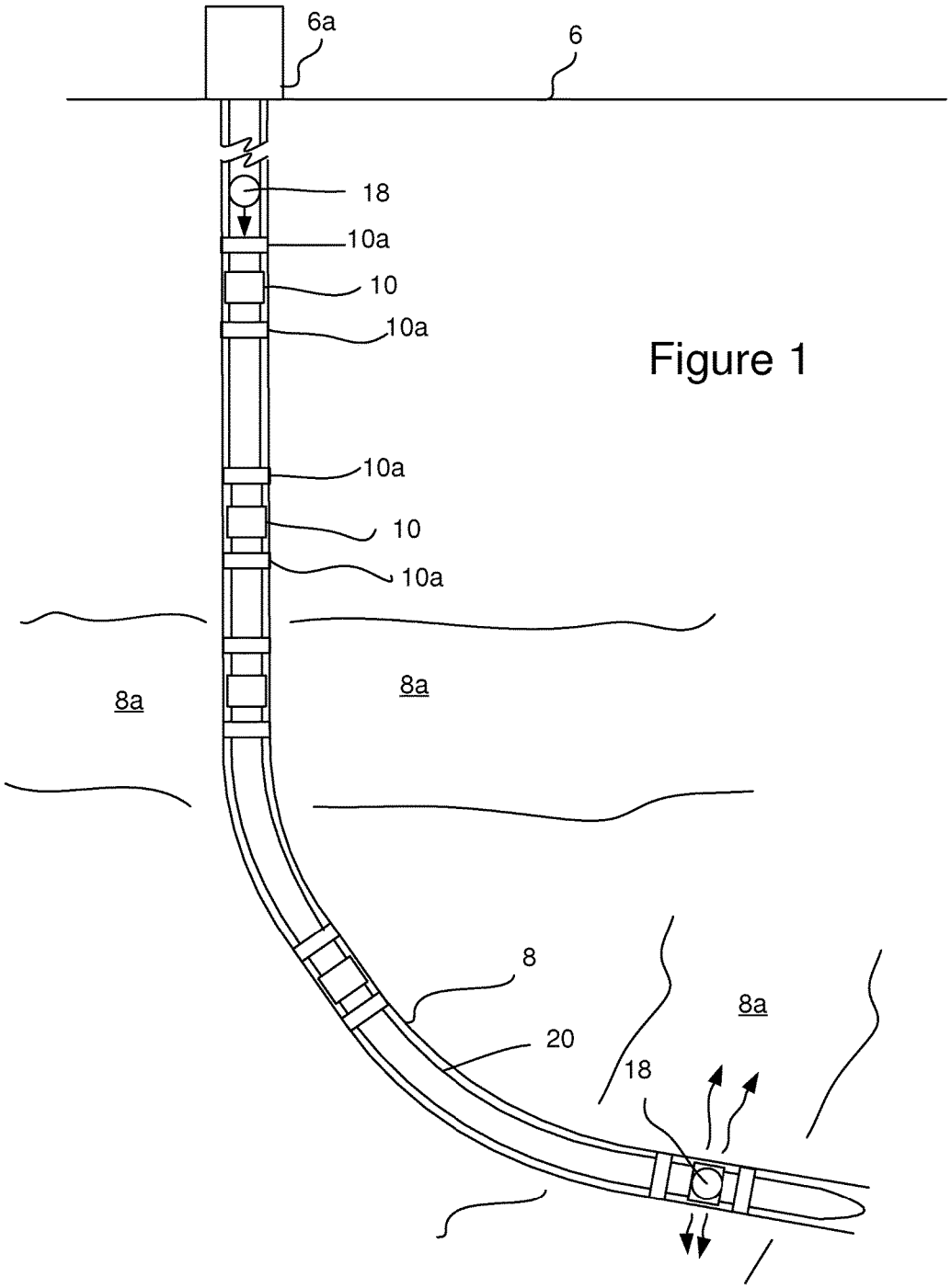
FIG. 1 is a schematic diagram of a deployed casing or completion tubing string incorporating several multi-stage fracturing devices in accordance with the invention together with corresponding packer elements.

For the purposes of description herein, the MFD or THV 10 includes a plurality of sub-systems that may be configured to a casing or completion tubing string 20 together with appropriate packer elements 10*a* to enable the isolation of particular zones within a formation 8*a* as shown in FIG. 1. In the context of this description a casing or completion string are synonymous and are referred to hereafter as a completion string. The combination of MFDs 10 and packer elements 10*a* on a completion tubing string 20 enable fracturing operations to be conducted within a formation 8*a* within a well 8.

It should also be noted that the system may be utilized without packer elements in situations for example where the completion string is cemented in place. While the following description assumes the use of packer elements 10*a*, this is not intended to be limiting.

As described in detail below, the MFD includes generally includes a counting sub-system 12, a ball-grab sub-system 14 and a valve sub-system 16 as shown schematically in FIG. 2.

It should be noted that the description utilizes various terms interchangeably with other terms for the purposes of functional description and/or to represent examples of specific embodiments. Importantly, the use of one term as compared to another is not intended to be limiting with regards to the scope of interpretation by those skilled in the art. For example, the description refers to the system as a multistage fracturing device (MFD) which is synonymous to a tubular hydraulic valve (THV) as well as to a "ball" or "plug" where a ball is but one example of a plug.

Operational Overview

With reference to FIG. 1, a number of MFDs 10 are connected to a completion tubing string 20 between packer elements 10*a* at positions that correspond to zones of interest (formations) 8*a* within the well. Generally, after placement of the completion tubing string 20 within the well 8, the assembled system can be pressurized at surface 6 through wellhead equipment 6*a* to cause the packer elements 10*a* to seal against the well 8. After circulation has been established in the well, balls 18 are released at surface 6 within the completion tubing string that fall and/or are pumped through the completion tubing string to successively engage with each MFD 10. Each MFD 10 within the string has been pre-configured to "count" each time a ball passes by the MFD and to trigger the capture of the ball 18 when the pre-determined count number is achieved. At the pre-determined count number (eg. 1-40), a specific MFD 10 will capture the ball 18 (see lowermost MFD 10 in FIG. 1). When a ball 18 is captured, the ball 18 seals the interior of the completion tubing from the lower regions of the completion tubing string such that additional hydraulic events can be initiated to open a valve within the MFD. That is, when the ball has been captured and a valve in the MFD 10 is opened a fracturing operation can be completed within a zone of interest 8*a* adjacent that MFD 10.

After a zone 8*a* has been fractured, further balls are successively introduced into the completion tubing to enable successive MFDs to be opened and fracturing operations to be completed within other zones. As a result, each of the zones of interest within the well 8 can be successively fractured. Importantly, the balls are designed such that over a period of time, typically a few days, the ball will at least partially dissolve such that its diameter is eroded and it will fall to the bottom of the well. Thus, after all fracturing operations have been completed all the zones of the well are then opened to the interior of the completion tubing to enable production of the well through the completion tubing.

It should be noted that the lowermost zone of the completion string does not require an MFD 10 and that a simple hydraulic valve that opens on pressure would normally be utilized at the lowermost zone (not shown) to initially establish circulation and to enable fracturing of the lowermost zone.

Figure 2:
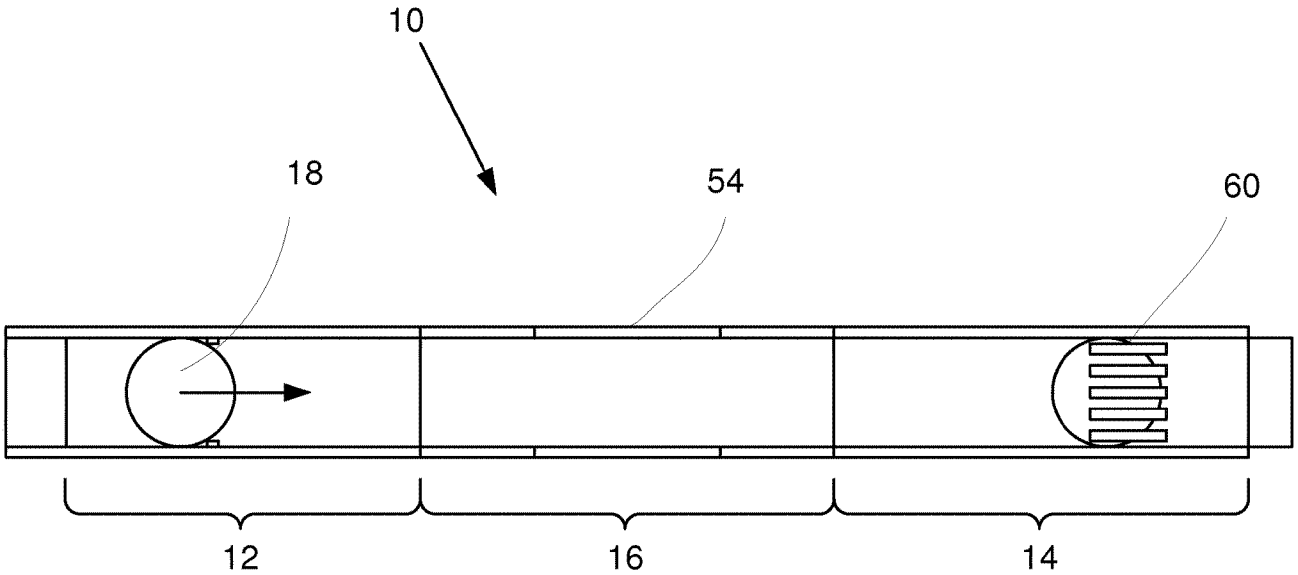
FIG. 2 is a schematic diagram of a multi-stage fracturing device (MFD) showing the general position of a counting system, valve system and ball-grab system in accordance with one embodiment of the invention.

As shown in FIG. 2, each MFD 10 is generally described as having three main sub-systems including a counting system 12 at the uphole end of the MFD 10, a ball grab system 14 at the downhole end of the MFD and a valve system 16 between the counting system 12 and ball grab system 14. During surface preparation of the completion tubing string, the counting system of each MFD is set to count a specific or pre-set number of balls where the lowermost MFD within the string will count 1 and the uppermost MFD with count n (where n is typically between 1 and 40). In operation, if the counting system 12 records that the pre-set number has not been reached, then the ball will pass through the MFD 10 and continue to travel downhole. If an MFD 10 records that the pre-set has been reached, the counting system 12 will trigger the ball grab system 14 to capture the ball to prevent further downhole travel. The action of capturing the ball will then enable a valve within the valve system 16 to open. By way of example, the lowermost MFD would be set to count 1 ball whereas an uppermost MFD within a string of 10 MFDs would be set to count 10 balls.

Figure 3A:
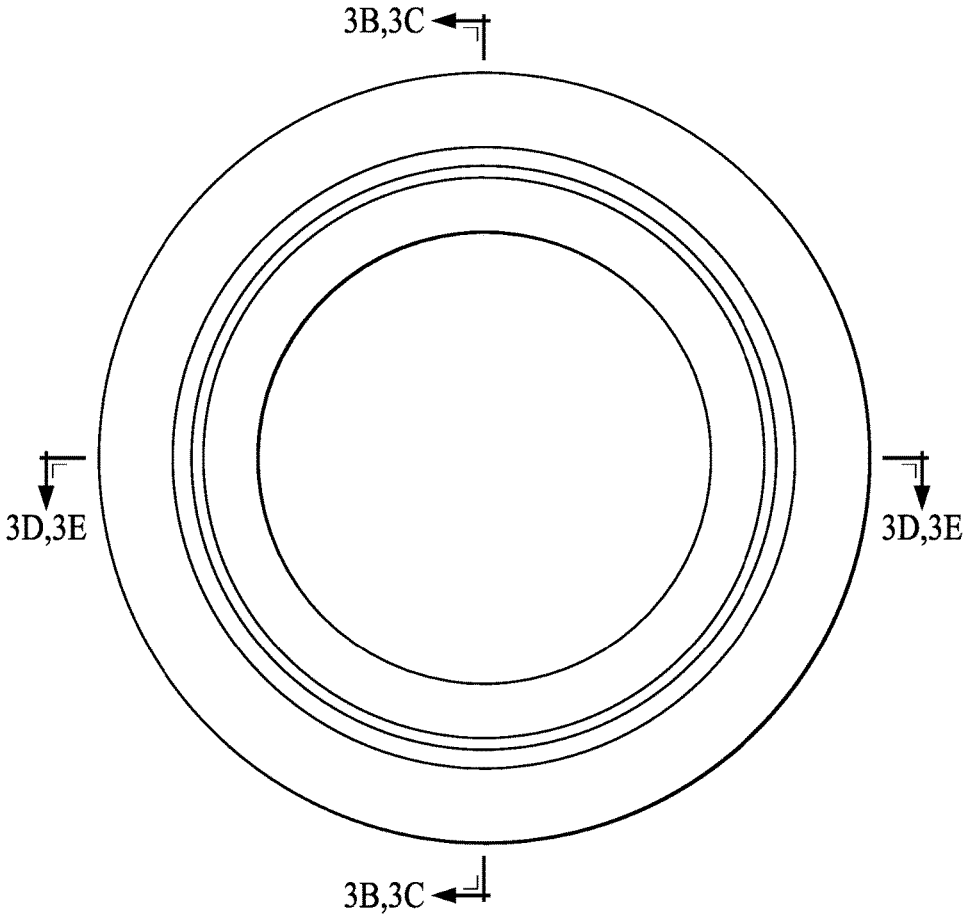
FIG. 3A is an axial cross-sectional view of an MFD in accordance with one embodiment of the invention.
Figure 3B:
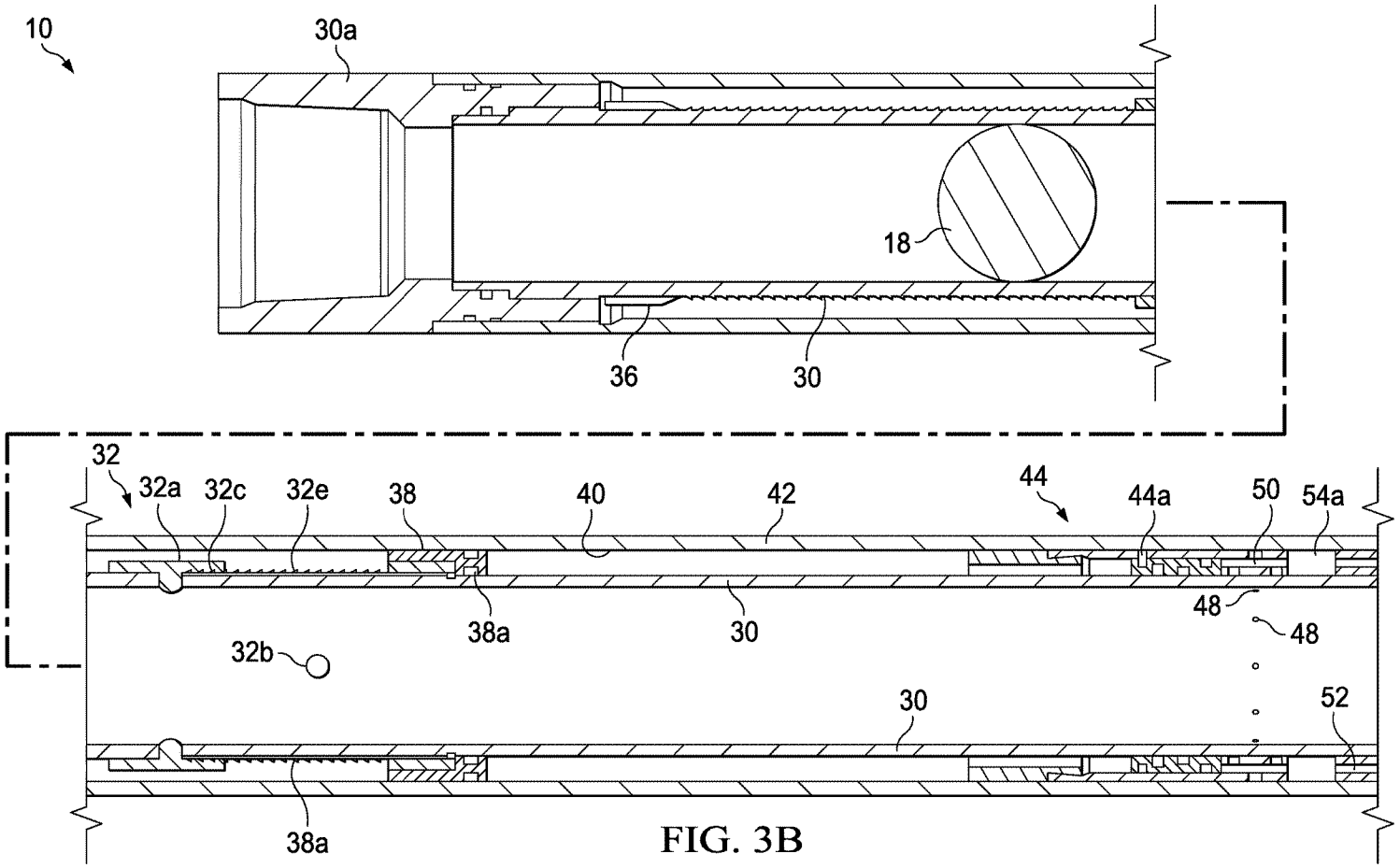
FIG. 3B-3E are a sequence of cross-sectional views of an MFD in accordance with one embodiment of the invention showing a ball in an uphole position.
Figure 3C:
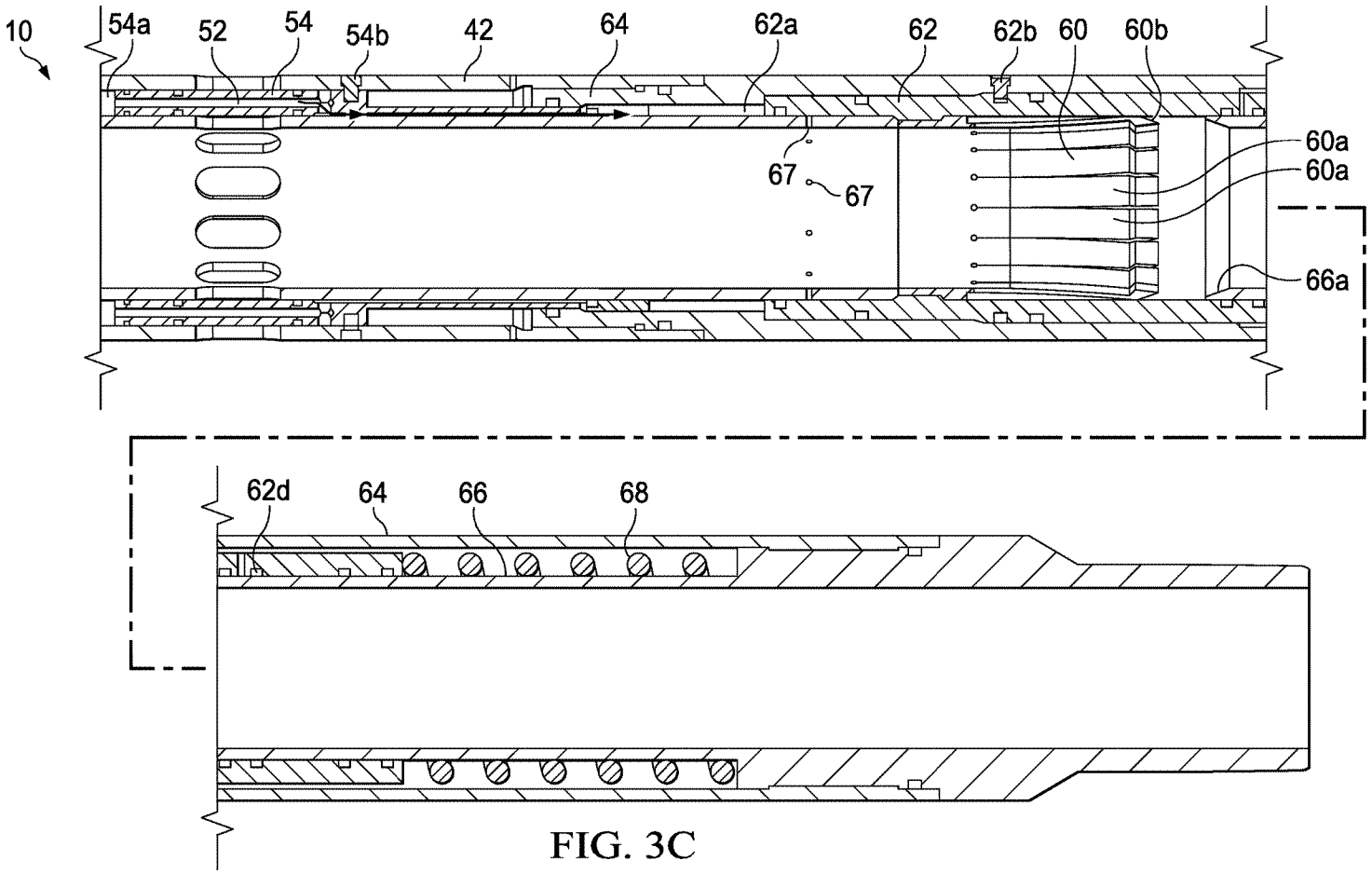
Figure 3D:
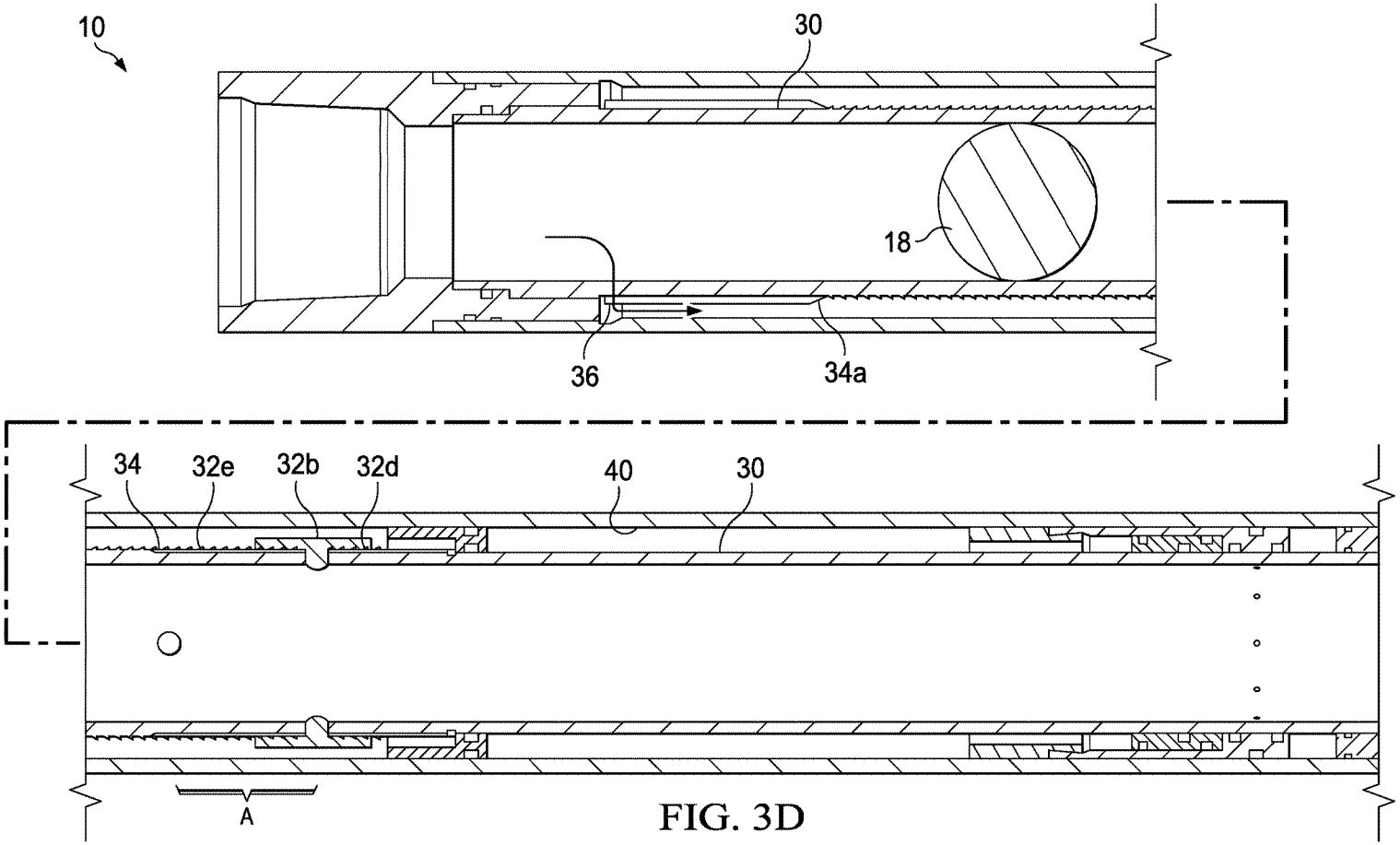
Figure 3E:
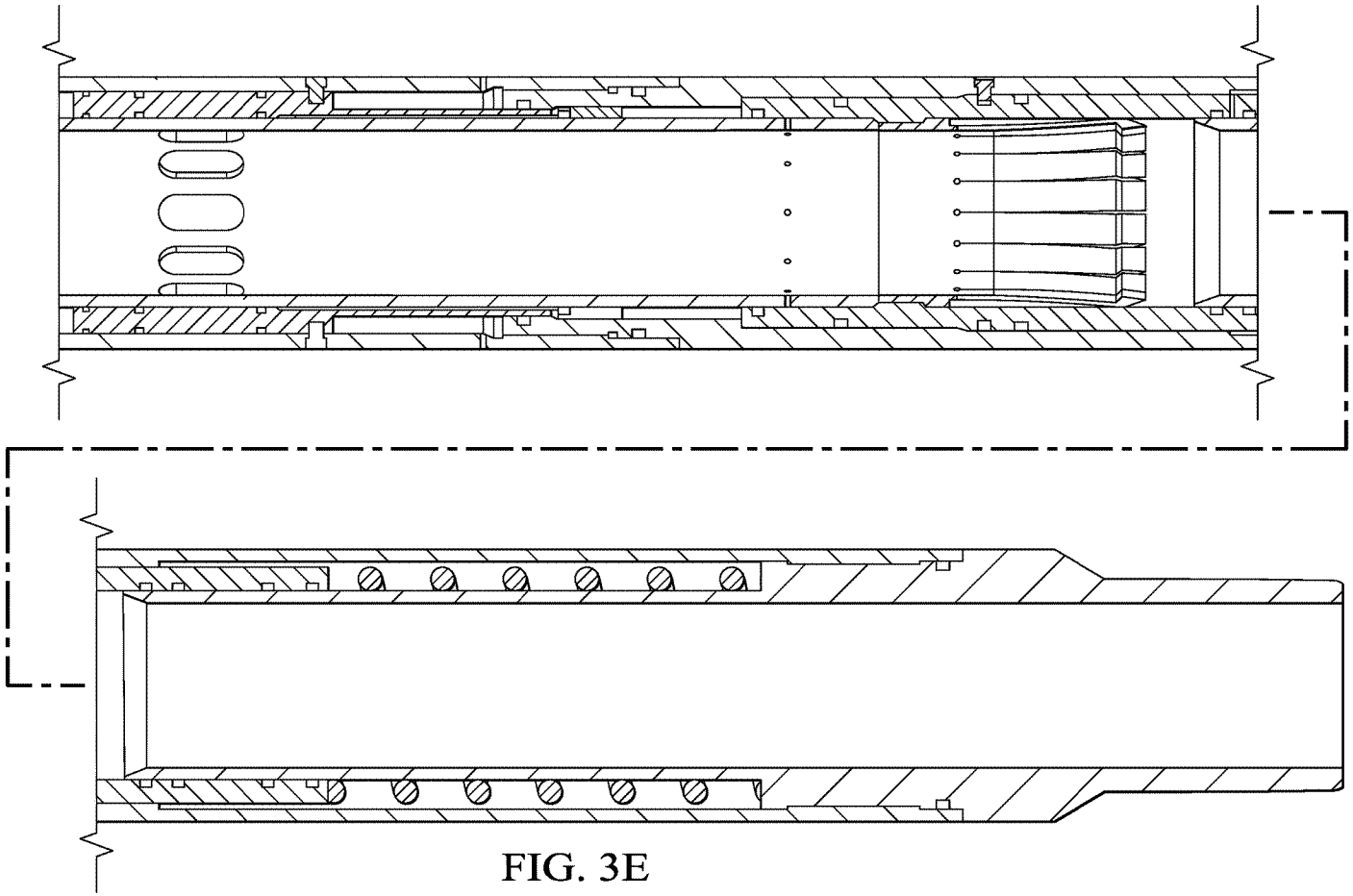

The operation and components of each of the sub-systems is described in greater detail below where FIGS. 3B and 3D show details of the counting system, FIGS. 3C and 3E show details of the valve and ball grab sub-systems and the downhole connection components that enable connection to downhole portions of a tubing string. FIGS. 3A-3E generally show the system in a counting configuration that allows a ball entering the MFD to be counted. The upper (I) and lower (II) images are cross-sections of the same region of the MFD at 90° to one another. FIGS. 4A-4E generally show the sub-systems after a ball has been grabbed.

Counting System 12

As shown in FIG. 3B, the upper section of an MFD is shown with a ball uphole of the counting system 12 having a pin and ratchet system that successively counts balls 18 progressing through the counting system 12.

As shown, a main internal housing 30 supports a pin system 32 having two pin pairs 32*a*, 32*b* that are generally biased towards the interior of the main inner housing 30. Each pin pair 32*a*, 32*b* are positioned 90° with respect to one another about the inner housing 30 and are separated by a short distance A along the main inner housing. The separation distance A is sufficient such that a ball 18 fully engages and disengages with pin pair 32*a* prior to engaging with pin pair 32*b*.

Each of the pin pairs 32 include a plurality of teeth 32*c*, 32*d* that engage with teeth 32*e* on a ratchet counter piston 34 on the outer surface of the main inner housing 30. That is, teeth 32*c* and 32*d* are opposed to teeth 32*e* and engage with one another. The ratchet counter piston 34 is slidingly engaged on the main inner housing 30.

In operation, as the ball 18 engages with the first pin pair 32*a*, teeth 32*c* disengage from teeth 32*e* on the ratchet counter piston 34 allowing the ratchet counter piston to move downhole one tooth position such that teeth 32*d* of pin pair 32*b* become fully engaged with teeth 32*e*. As the ball 18 moves past the first pin pair 32*a*, teeth 32*c* move to an intermediate position against the ratchet counter piston 34. As the ball 18 moves past the second pin pair 32*b*, teeth 32*d* disengage from the teeth 32*e* causing additional downhole movement of the ratchet counter piston 34 and engagement of teeth 32*c* of pin pair 32*a* with teeth 32*e*.

As such, as successive balls move past the pin pairs 32, the ratchet counter piston 34 will progressively move downhole. The driving force for ratchet counter piston 34 movement is internal hydraulic pressure acting through pressure port 36 (FIG. 3A) against ratchet seal piston 38. Chamber 40, defined by main internal housing 30 and main outer housing 42 is set at atmospheric pressure during string assembly such that a pressure differential exists across the ratchet seal piston 38. Ratchet seal piston 38 includes appropriate seals 38*a* to maintain the pressure seal during operation.

In addition, ratchet counter piston 34 includes an uphole shoulder 34*a*, that will engage with pin pair 32*a* as the ratchet counter piston 34 progressively moves downhole as a result of successive balls passing. More specifically, after a pre-set number of balls have engaged with the pin pairs, the upper shoulder 34*a* will prevent pin pair 32*a* from re-engaging with the ratchet counter piston 34 such that the ratchet counter piston will slide to engage with shift piston assembly 44.

The action of the ratchet counter piston 34 engaging with the shift piston assembly 44 will cause a high pressure force to be applied to the shift piston assembly 44. That is, as a result of high pressure hydraulic fluid flow through ports 36, shear pin 44*a* within the shift piston assembly 44 will shear such that the shift piston assembly 44 will move downhole. The downhole movement of the shift piston assembly 44 causes the alignment of pressure ports 48 with hydraulic channel 50 within the shift piston assembly 44 which thereby allows high pressure hydraulic fluid to flow into hydraulic channel 50 (See FIG. 4B).

A further hydraulic channel 52 (FIGS. 3B, 3C) is contained within valve sleeve 54 that allows hydraulic fluid to by-pass the valve system 16 to the ball grab system 14.

Ball Grab System 14

The ball grab system 14 generally includes a collet ball seat 60 having collet ball seat fingers 60*a* operatively contained within a seat piston 62. The collet ball seat 60 and seat piston 62 are retained within a seat housing 64. The seat housing 64 is secured to the main outer housing 42 at its uphole end and to a bottom connector sleeve 66 (FIG. 3D) at its downhole end. The seat housing 64, bottom connector sleeve 66 and seat piston 62 retain a return spring 68 that is compressible by the downhole movement of the seat piston 62.

As explained in greater detail below, as the seat piston 62 moves downhole, the seat piston 62 engages with the collet ball seat 60 such that the collet ball seat fingers 60*a* move to a position that collectively define a ball retaining lip 60*b* (FIG. 4B) that will prevent passage of a ball 18 past the collet ball seat 60.

In operation, as the high pressure hydraulic fluid passes through hydraulic channel 52 as described above, the hydraulic fluid pressurizes pressure chamber 62*a* uphole of seat piston 62. Chamber pressurization causes shear pins 62*b* to shear enabling downhole movement of the seat piston against return spring 68 and the inward movement of the collet ball seat fingers 60*a* (FIG. 4B).

Importantly, as the seat piston 62 moves downhole, locking mechanism 63 (see FIG. 4E) is released to a locking position that prevents partial subsequent uphole movement of the seat piston 62 as explained in greater detail below.

Figure 4A:
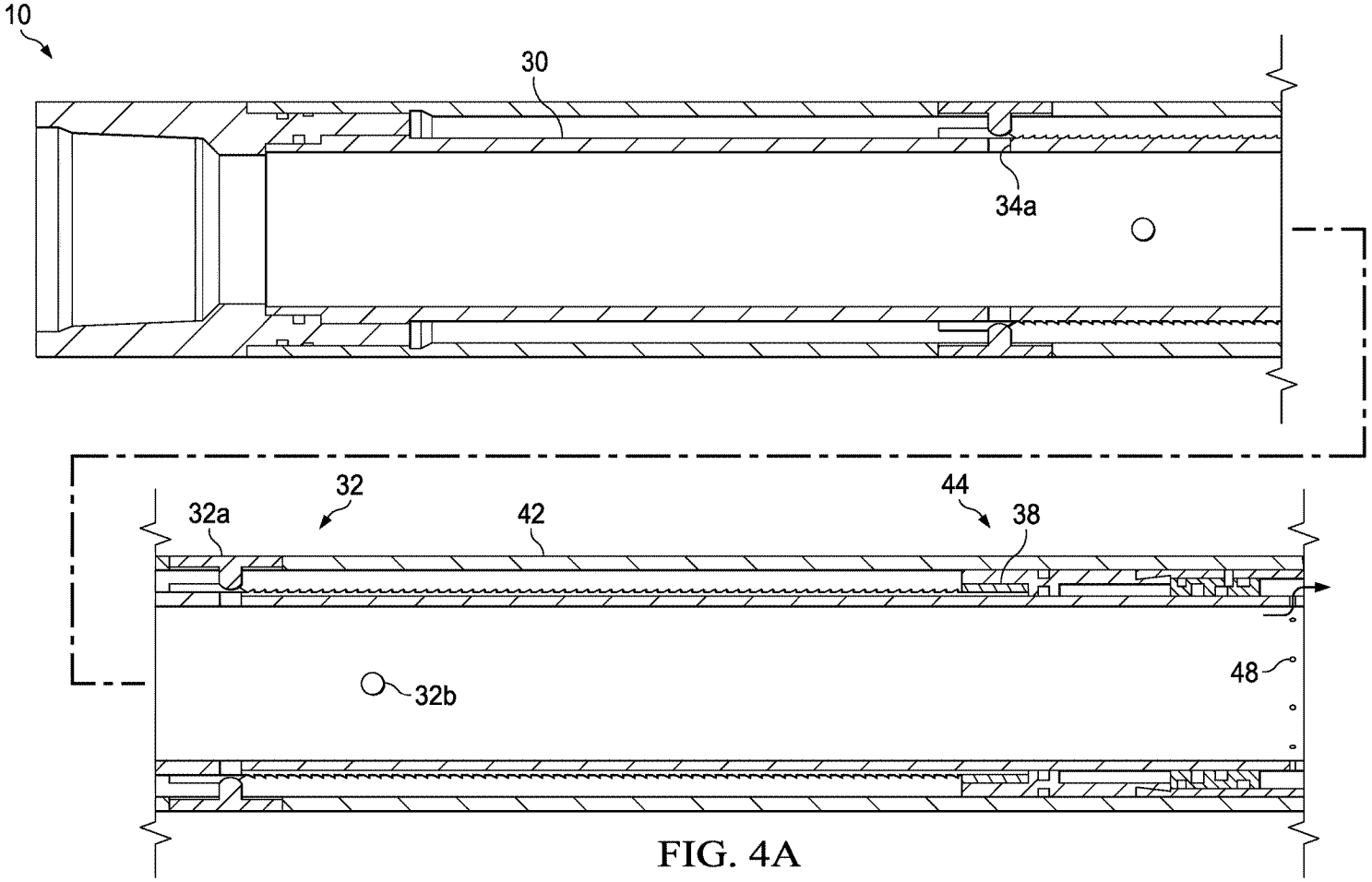
FIGS. 4A-4E are a sequence of cross-sectional views of an MFD in accordance with one embodiment of the invention showing a ball in a captured position.
Figure 4B:
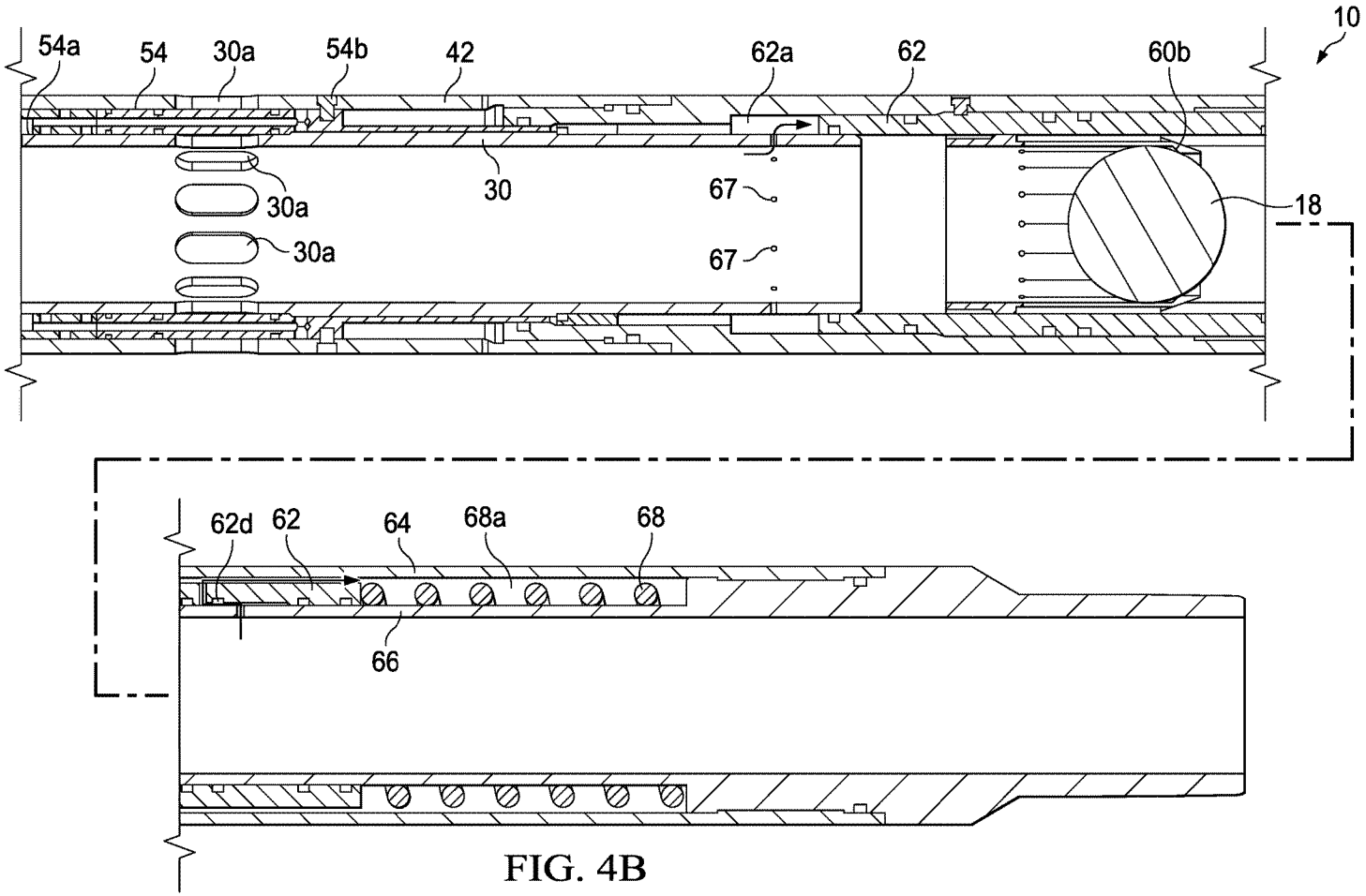

In one embodiment, the collet ball seat fingers 60*a* have an outer wedge surface 60*b* that will engage with inner wedge surface 66*a* to facilitate positive inward movement of the collet ball seat fingers 60*a* (FIG. 4B).

As a result, as the ball counter system 12 causes activation of the ball grab system 14 at the correct pre-set number, a ball 18 is retained within the collet ball seat, thus sealing off positions downhole of the ball (see FIG. 4B).

In addition, as the seat piston 62 moves downhole, ports 67 become exposed to chamber 62*a* such that additional high pressure fluid is introduced into chamber 62*a* to ensure pressurization of the chamber 62*a* (See arrow in FIG. 4B)

Valve System 16

Figure 4C:
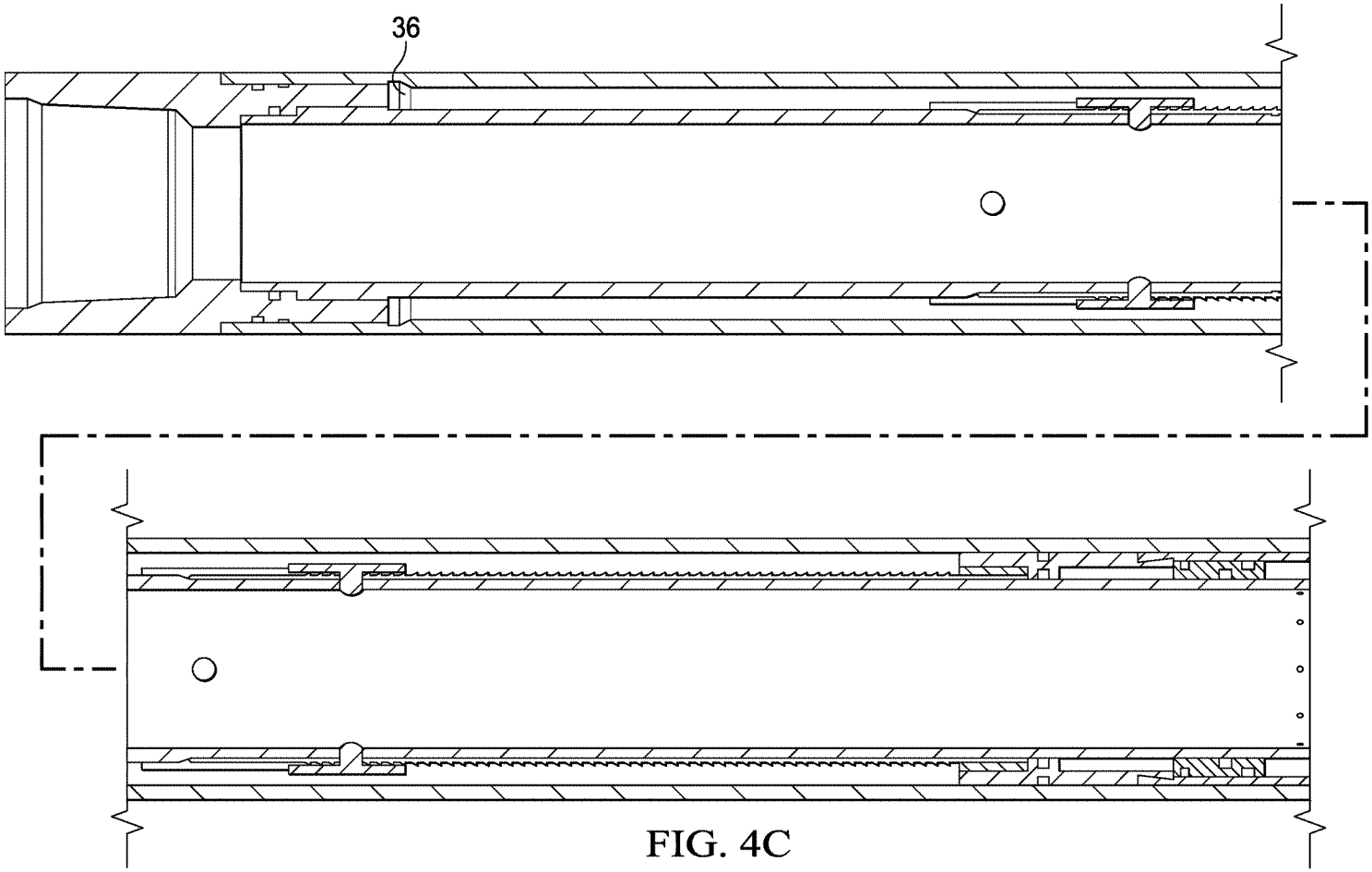
Figure 4D:
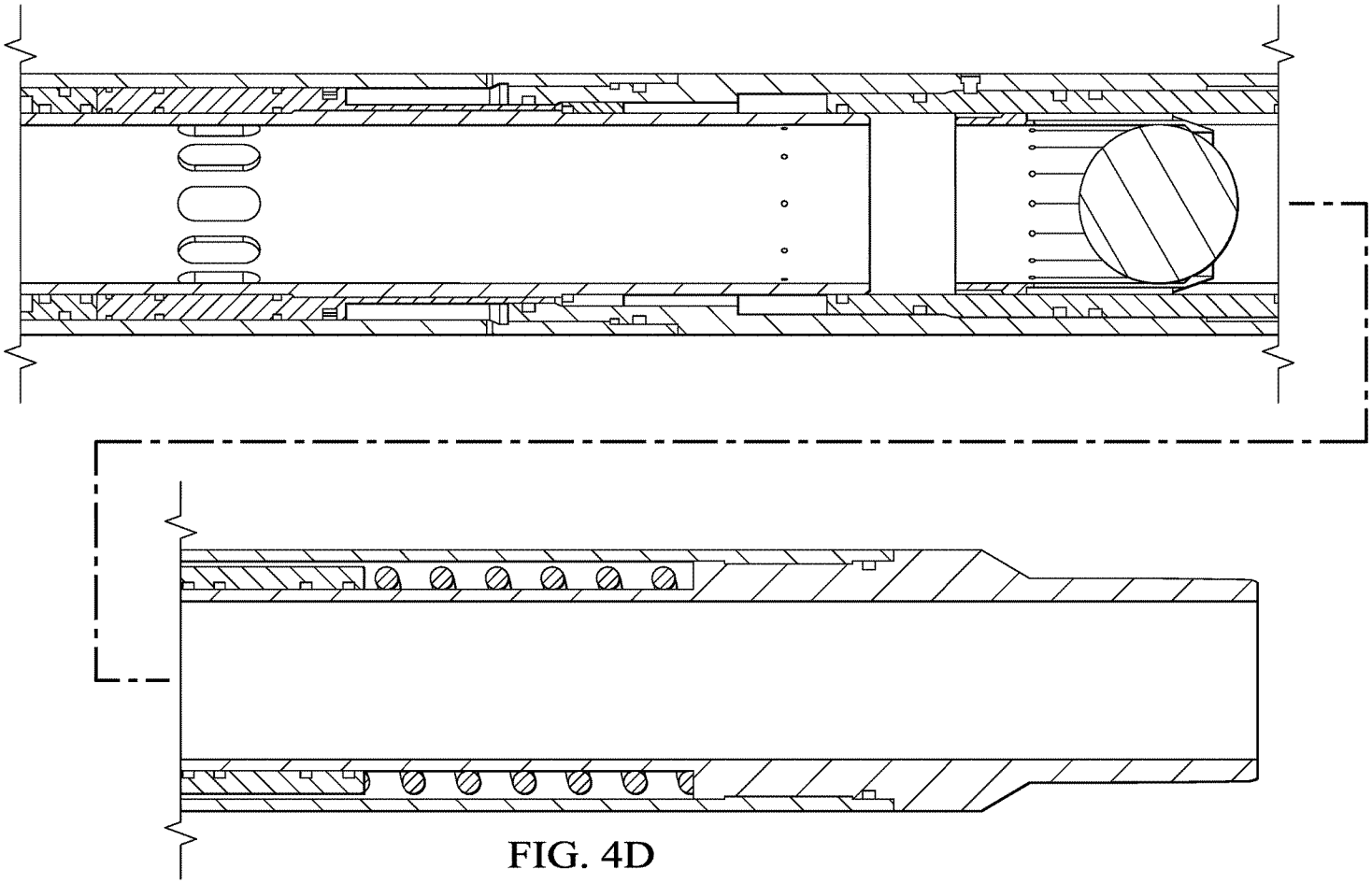
Figure 4E:
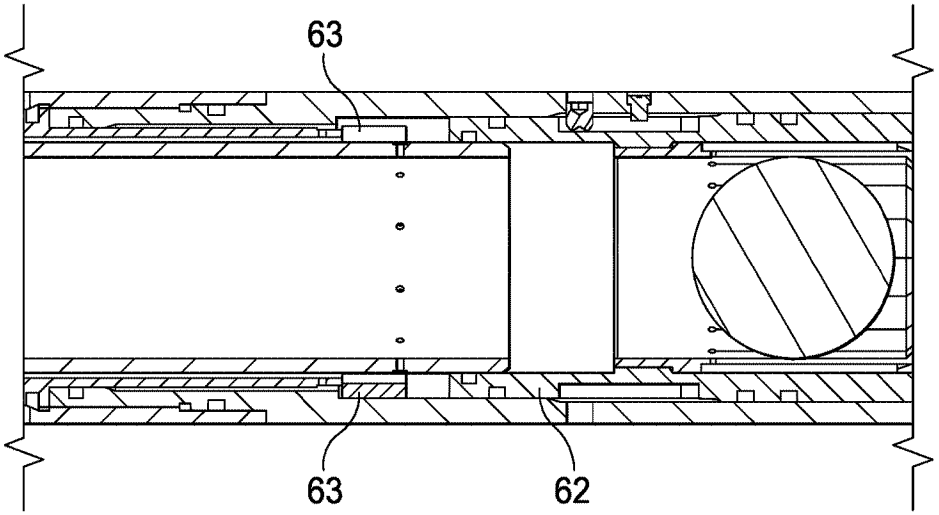
Figure 5A:
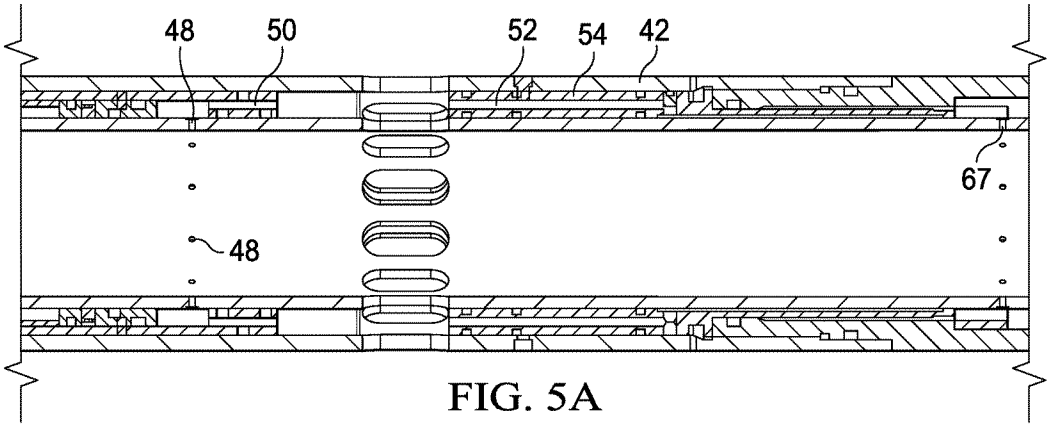
FIG. 5A-5B are cross-sectional drawings of an MFD showing a valve sleeve in an open position.
Figure 5B:
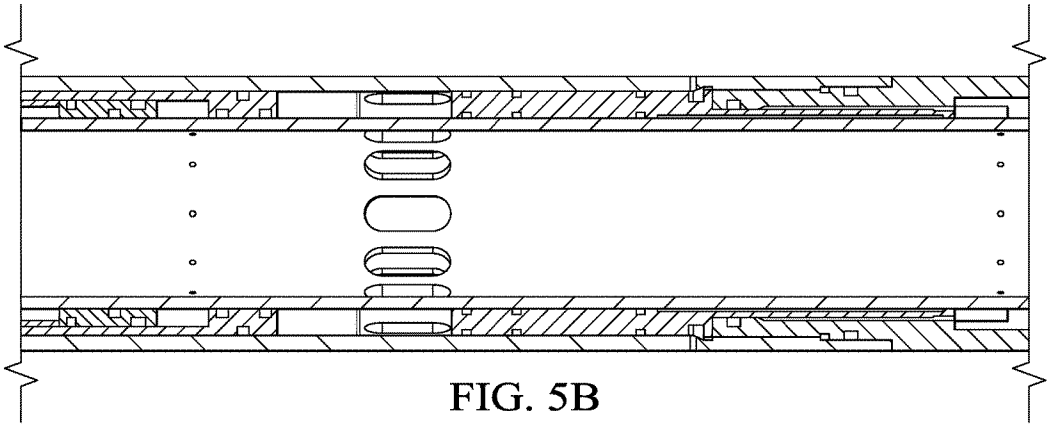

The valve system 16 includes valve sleeve 54. FIGS. 3C and 4C show the valve sleeve 54 in a closed position whereas FIG. 5A-5B show the valve sleeve 54 in an open position.

After a ball has been retained in the collet ball seat 60, increasing the pressure within the completion tubing will result in additional pressurization against uphole surface 54*a* of the valve sleeve 54. The valve sleeve 54 is retained against the main outer housing 42 by shear pin 54*b* which upon reaching a threshold pressure will shear thereby allowing valve sleeve 54 to move downhole such that openings 30*a* in the main internal housing 30 and main outer housing 42 are opened to the formation.

Importantly, if a ball has not been captured within the ball capture system, maintaining or increasing the pressure within the tubing string does not enable the valve sleeve 54 to move and cause premature opening of a valve sleeve 54 in a zone where a ball has not been captured. More specifically, this is prevented by the position of the shift piston 44 in a non-triggered MFD that prevents the flow of hydraulic fluid into chamber 54*a* through hydraulic ports 48. Thus, if the pressure is increased to open a valve sleeve, this will only occur if hydraulic fluid can flow into chamber 54*a* which can only occur if a ball has been captured.

Thereafter, further increases in pressure enable fracturing operations to be conducted.

Upon completion of a fracturing operation within a particular zone and the partial relaxation of pressure, the process is repeated by dropping a further ball which based on the pre-set counter setting of the immediately adjacent uphole MFD 10 will capture the further ball at that uphole position. The process is repeated for each of the MFDs present in the completion tubing string.

After completion of the fracturing operations, it is important that the balls are all released to fall to the bottom of the string to ensure that the entire string is opened to the formation at all zones.

As known, the balls can be dissolvable such that over a period of few days, the outer surface of the ball will erode such that it will fall from the collet ball seat arms 60*a*.

In one embodiment, the seat piston 62 is also provided with a dissolvable o-ring 62*d* located adjacent the lower end of the seat piston and engaged with the bottom connector sleeve 66. Over time, the dissolvable o-ring 62*d* will fail which will allow high pressure fluid to flow as shown from the interior of the MFD to chamber 68*a*. That is, when the seat piston 62 has shifted downhole to catch a ball, this opens hydraulic passage 62*e* that then allows high pressure fluid to come into contact with the o-ring 62*d*. Over time, the o-ring will dissolve and fail which then allows the fluid to enter chamber 68*a* via the path shown in FIG. 4D. When fluid enters chamber 68*a* which is previously at atmospheric pressure, the seat piston 62 is then pressure balanced which allows the seat piston 62 to move back uphole, and thereby unseat the ball (if not already dissolved). Importantly, regardless of whether the ball has dissolved or not, the minimum inside diameter (ID) of the tool is returned to its original ID. As noted above, locking mechanism 63 has been engaged to prevent full uphole movement to the original uphole position thereby preventing closure of hydraulic ports 67.

Other Design Considerations and Aspects of the System

The ratchet counter system will typically enable 1-40 zones to be individually isolated for treatment. In order to ensure a proper pre-set number, as the completion tubing string is being assembled at surface, each MFD 10 will be set to trigger based on the intended MFD position in the well. That is, if the string includes 10 MFDs, the lowermost MFD will trigger with the first ball and uppermost MFD will trigger with the $10^{th}$ ball. Thus, each counter system 14 will have its ratchet counter piston 34 positioned on the appropriate tooth ring relative to the pin pair teeth.

Electronic Counting System

Figure 6:
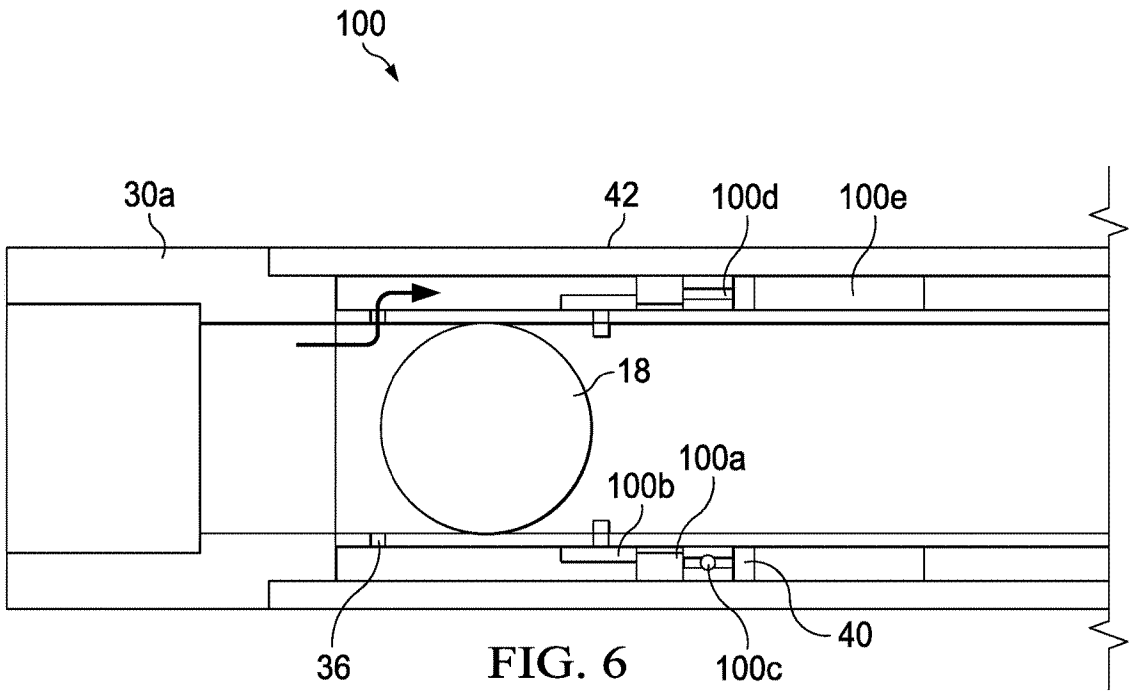
FIG. 6 is a schematic diagram of an electronic ball counting system in accordance with one embodiment of the invention.

In another embodiment as shown in FIG. 6, the counting system incorporates an electronic counting system 100. In this embodiment, the system includes a processor and power system 100*a* operatively connected to a pin system 100*b* and solenoid valve and/or electric motor 100*c*. In this embodiment, as a ball 18 moves past the pin system 100*b*, the processor 100*a* counts the number of balls that have passed. When the processor has counted a pre-set number of balls, the processor 100*a* activates a solenoid valve 100*c* to enable hydraulic fluid to flow through a hydraulic channel 100*d* into space 40 to engage against piston 100*e* and activate the ball grab system as described above. Hydraulic fluid enters space 40 through port 36.

Figure 8A:
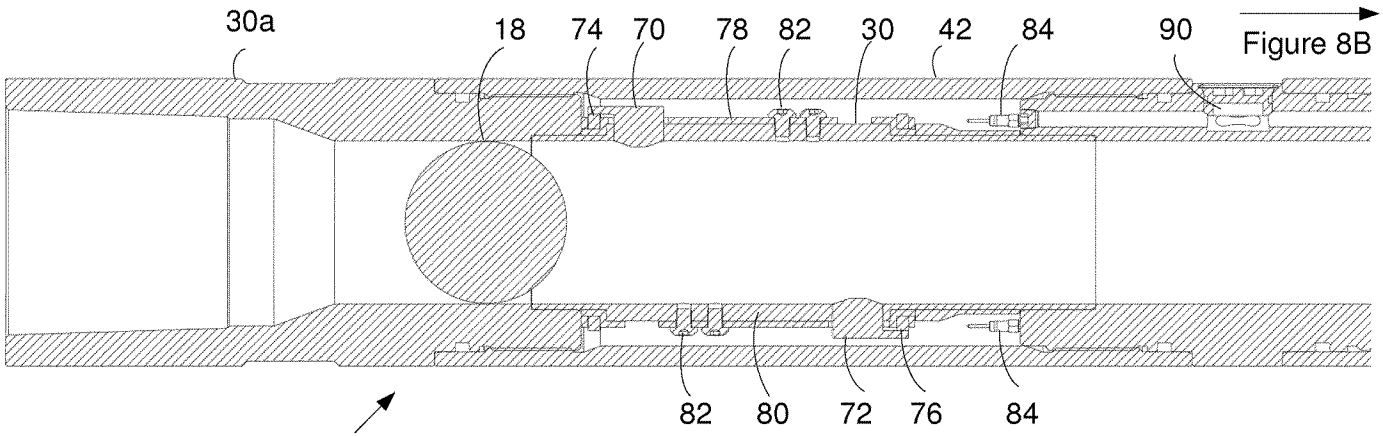
FIG. 8A is cross-sectional view of an uphole portion of an MFD having an electronic counting system showing a two pin system in accordance with one embodiment of the invention.
Figure 8B:
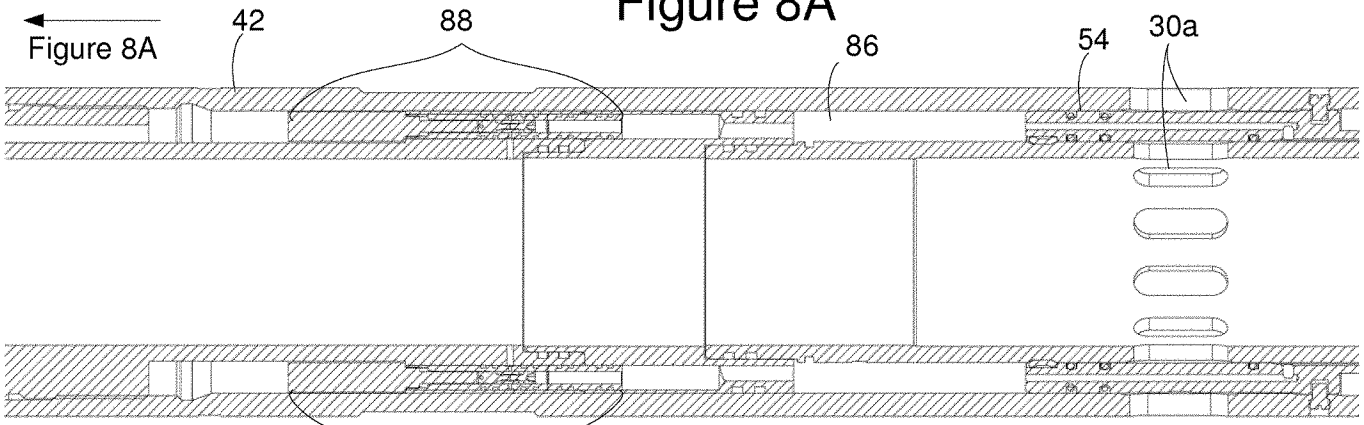
FIG. 8B is a continuation of the MFD of FIG. 8A illustrating a cross-sectional view of a middle portion of the MFD having an electronic counting system showing a solenoid valve system in accordance with one embodiment of the invention.

In another embodiment shown in FIGS. 8A-8B, there is an MFD 10 containing an electronic counting system 100. Only the section of the MFD 10 containing the electronic counting system is illustrated and described since the ball grab system and other components are similar to those described above. The electronic counting system includes a first and second pin 70, 72 that are spaced apart from each other in the inner bore along the longitudinal axis. The first and second pins are independently movable to contact a first and second electrical circuit, respectively, to close or complete the electrical circuits. A first and second biasing means 78, 80 bias the pins in a first position wherein the electrical circuits are complete. As a ball moves past one of the pins and contacts the pin, the pin is moved to a second position wherein the electrical circuit is open or incomplete. After the ball completely passes the pin, the biasing means causes the pin to return to the first position. Alternatively, in the first position the electrical circuit is in the incomplete or open position, and in the second position the electrical circuit is closed when the ball is in contact with the pin.

The first and second pin are preferably out of phase (not in line) with each other along the inner bore, and preferably are phased at 180 degrees from each other. While the first and second pin may be in phase/in line with each other, having them out of phase provides more even wear on the balls as they pass by the pins and provides room in the tool for the biasing means and other parts related to the electronic counting system.

Figure 7A:
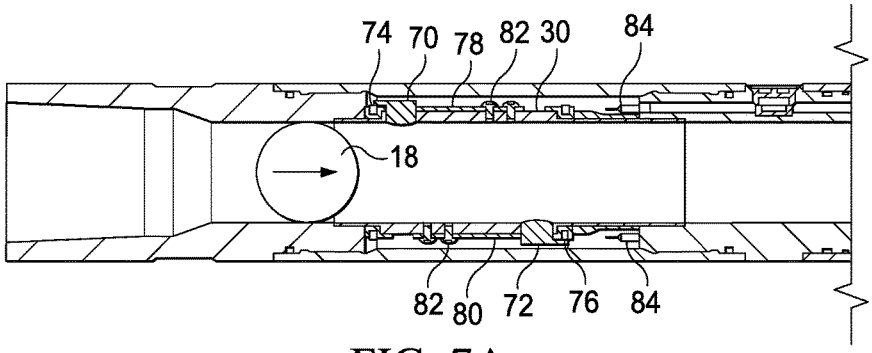
FIGS. 7A-7E are cross-sectional views of an uphole portion of an MFD having an electronic counting system illustrating a sequence of a ball moving through the MFD in accordance with one embodiment of the invention.
Figure 7B:
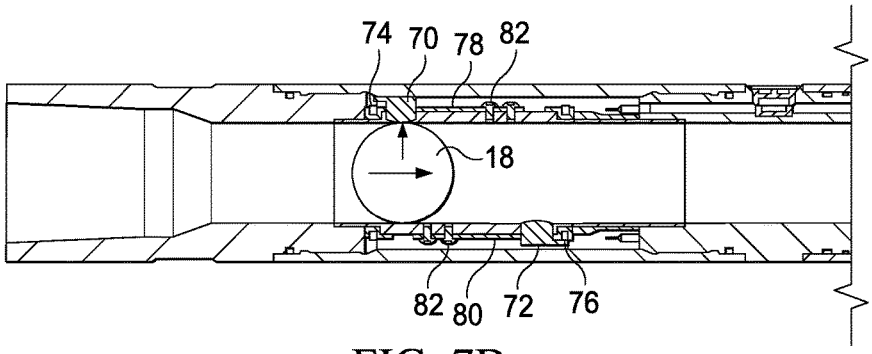
Figure 7C:
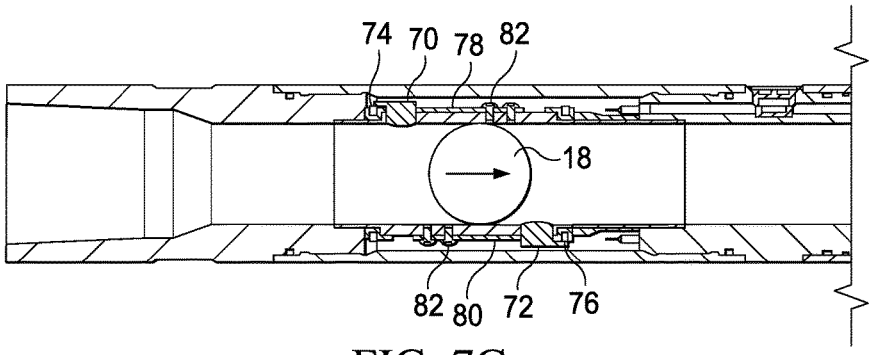
Figure 7D:
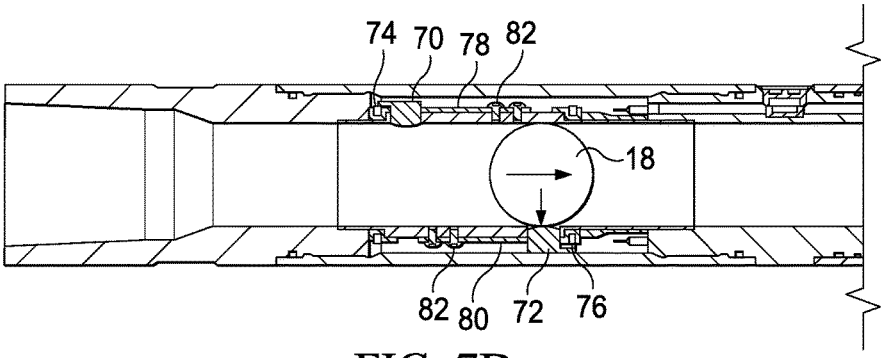
Figure 7E:
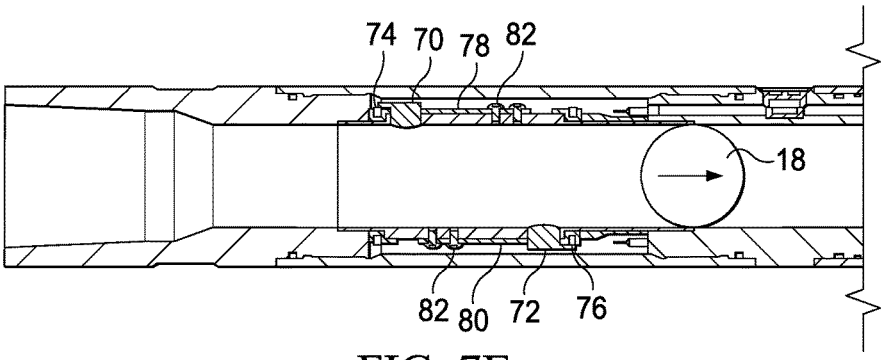

FIGS. 7A to 7E show close up views of the sequence of a ball moving past the two pins. In this embodiment, the first and second pins are biased in a first position in contact with a first and second ring or element 74, 76 to close the first and second electrical circuits, respectively. The biasing elements 78, 80 are illustrated as beam springs fastened to the inner housing 30 by fastening means 82. When a ball 18 passes one of the pins, it pushes the pin out away from the ring or element 74, 76 into an open position to disconnect one of the electrical circuits. FIG. 7B illustrates a ball passing by the first pin 70 and pushing the pin out into an open position. FIG. 7D illustrates the ball passing by the second pin 72 and pushing the pin out into the open position. FIG. 7C illustrates the ball after it has fully passed by the first pin 70 but before it contacts the second pin 72, wherein both pins are in the closed position. The pins are spaced apart enough to allow the first pin to close after the ball has passed by before the second pin is opened. FIG. 7E illustrates the ball after it has passed by both pins.

In another embodiment, rather than first and second pins that are spaced axially apart, the electronic counting system utilizes two pairs of pins. For each pair, both pins are located at the same axial location along the inner bore of the main internal housing and, similar to the embodiment described above, the pairs of pins are axially spaced apart far enough to allow the first pair of pins to close after the ball has passed through before the second pair of pins is opened. The pins may also be circumferentially spaced apart around the inner bore of the main internal housing. For example, the first pair of pins may be located at 0° and 180° respectively, while the second pair may be located at 90° and 270°. Other similar embodiments are possible, including designs that use more than two pins at each axial location, pins located at more than two separate axial locations, or a different number of pins at one axial location versus another.

This alternative embodiment utilizing two pairs of pins is useful to reduce the likelihood that the electronic counting system will count objects other than balls or other devices designed to induce a count. For example, if coiled tubing is inserted into the well, an electronic counting system utilizing only a single pin at each axial location could inaccurately count the coiled tubing as a ball, in the event that the coiled tubing contacted the single pins, thus causing the first and second electrical circuits to open (or close). Utilizing pairs of pins as described in the preceding paragraph should ensure that the electronic counting system will only count balls or other specially designed tools or devices that have the same approximate diameter as the inner bore of the main internal housing.

When either the first or second electrical circuit open or close, a signal is passed (via wires or wirelessly) to a solenoid processor (not shown) in the tool using electrical pins 84. In the illustrated embodiment, when a signal is passed to the processor that the first electrical circuit has opened then closed, followed shortly by the second electrical circuit opening and closing, the processor interprets this as a ball passing downhole. Alternatively, if the pins are biased in the open position, the signal to determine that a ball has passed downhole may be the first electrical circuit followed by the second electrical circuit closing then opening. The processor keeps a count number for the passing balls. Upon reaching a pre-determined count number, the processor signals a solenoid valve assembly 88 to open, allowing fluid to enter a cavity 86, thereby setting the tool to capture a ball which, as with the non-electronic system described above, allows a valve in the MFD 10 to be opened to allow fracturing operations to occur. The electronic counting system may include more than one solenoid valve assembly for redundancy and to enable the setting process to occur faster.

Referring to FIG. 8A, the tool may also include one or more ports or plugs 90 which provide access to the electronics of the counting system for programming the counting system. The tool preferably also contains a power source for the electronic counting system, such as one or more batteries (not shown).

The electronic counter system is not limited to a maximum number of ball counts and therefore has no limit on the number of fracturing stages that the MFD can be used for. The response time after a ball has passed the pins to the setting of the setting of the solenoid valve system can also be programmed as desired. This is particularly useful when it is desired to open more than one MFD with a single ball to simultaneously fracture more than one zone of interest. For example, the time between a ball passing an upper MFD and the setting of the upper MFD solenoid valve system can be delayed enough to allow the ball to pass through without being captured, after which the MFD is set. When the ball is captured by a lower MFD and pressure is applied downhole, both the upper and lower MFD will open, allowing fracturing to occur simultaneously in the zones adjacent both the upper and lower MFD.

Additionally, the electronic counter system can distinguish between a ball flowing downhole and ball flowing uphole. This is particularly useful when the direction of flow in a wellbore must be reversed due to a screen out (flow suddenly stopping in the wellbore) or the fracture failing to initiate. In both cases, the well is "opened up" and allowed to flow in the reverse direction back to the surface. After the desired amount of time, the flow direction is changed again to flow downhole in an attempt to start or restart the fracturing process. When flow is reversed, the balls often flow uphole with the fluid, passing the counting system in a reverse direction. The counting system will know a ball has moved uphole since the second pin will be triggered before the first pin. The processor may be programmed to not count an uphole flowing ball, or to count it as a negative. That is, when the ball moves downhole past the two pins it is counted as one, when the ball flows back uphole past the two pins, the count returns to zero, and when the ball moves back downhole past the two pins, it is again counted as one. This ensures that the count number is accurate despite the occurrence of reverse flow in the wellbore.

Pressurization

The entire operation will be conducted at different pressures to enable each of the packer setting, ball capture, valve opening and fracturing operations to be conducted. That is, each stage of operation can have a threshold pressure that will enable each operation to be sequentially completed. For example, the packer elements 10*a* may set at 2500 psi prior to dropping a ball downhole. Prior to dropping a ball, the system may be further pressurized to 3000 psi which is the pressure at which the shear pin 46 within the shift piston assembly 44 will shear if the appropriate count number within an MFD is reached. Similarly, the shear pin 54*b* within the valve assembly may shear at this pressure level (or higher) if the ball grab system has been triggered. After valve opening, formation fracturing may be conducted at higher pressure levels which may typically be in the range of 4000 psi. It should be noted that typical pressure ranges for the packer setting, valve opening and fracturing operations are typically 1500-2500 psi, 2500-4000 psi and 4000-10000 psi respectively.

Although the present invention has been described and illustrated with respect to preferred embodiments and preferred uses thereof, it is not to be so limited since modifications and changes can be made therein which are within the full, intended scope of the invention as understood by those skilled in the art.

The invention claimed is:

1. A tubular hydraulic valve (THV) system for connection to a tubing string to enable isolation of a zone of interest within a well, to enable access to a downhole formation for fracturing the zone of interest and for hydrocarbon production, the THV having an internal bore enabling a plug to pass through the THV, the THV comprising:

a plug counting system having an uphole end for connection to a tubing string and a plug engagement system for engagement with a plug passing through the internal bore, the plug engagement system configured to:

count successive plugs passing through the plug counting system until a pre-set number of plugs has passed through the internal bore; and trigger a first hydraulic event when the plug corresponding to the pre-set number of plugs passes through the internal bore, said first hydraulic event comprising the communication of internal hydraulic pressure through one or more hydraulic channels;

a plug capture system operatively connected to the plug counting system, the plug capture system responsive to the first hydraulic event to effect plug capture within the THV when the first hydraulic event is triggered, such that the same plug that triggered the first hydraulic event is also captured by the plug capture system;

the plug capture system comprising a seat piston and collet ball seat configured such that, upon triggering of the first hydraulic event, downhole movement of the seat piston engages the collet ball seat such that fingers of the collet ball seat move inward to restrict the internal bore of the THV to a diameter smaller than the diameter of the plugs; and a valve system operatively connected to the plug counting system and plug capture system, the valve system including a valve responsive to plug capture to open the valve to enable fluid flow from the internal bore to the exterior of the THV.

2. The system as in claim 1 wherein the plug engagement system includes at least one pin connected to a tooth ratchet and a plug piston wherein engagement of a plug passing through the internal bore with the at least one pin advances the tooth ratchet a tooth distance.

3. The system as in claim 2 wherein the tooth ratchet can be pre-set to travel a multiple of the tooth distance prior to triggering the first hydraulic event corresponding to a total number of plugs passing through the internal bore.

4. The system as in claim 3 wherein when the tooth ratchet has travelled a pre-set distance, the plug counting system enables hydraulic fluid to pass from the internal bore to pressurize the plug piston and cause downhole movement of the plug piston.

5. The system as in claim 1 further comprising a first hydraulic channel between the plug counting system and the plug capture system and wherein downhole movement of the plug piston opens the first hydraulic channel allowing hydraulic fluid to flow to the seat piston.

6. The system as in claim 5 further comprising a plug capture lock operatively connected to the plug capture system, the plug capture lock for engagement with the seat piston to prevent full uphole movement of the seat piston.

7. The system as in claim 6 further comprising a valve piston and wherein when the plug capture system has retained a plug, the valve piston is exposed to hydraulic fluid within the internal bore to cause downhole movement of the valve system to open a valve.

8. The system as in claim 1 wherein the plug counting system includes a processor and power system operatively connected to a plug engagement system and to a solenoid valve and/or electric motor for controlling the flow of hydraulic fluid through a hydraulic channel wherein a plug passing through the internal bore is counted by the processor and when a pre-set number of plugs are counted, the processor opens the solenoid valve and/or electric motor thereby triggering the first hydraulic event.

9. The system as in claim 8 wherein the plug engagement system includes at least one movable pin in operative engagement with an electrical circuit, wherein engagement of a plug with the at least one pin as the plug passes through the internal bore moves the pin and connects or disconnects the electrical circuit and sends a signal to the processor that a plug has passed.

10. The system as in claim 9 wherein the plug engagement system includes two movable pins spaced apart longitudinally in the internal bore, each pin in operative engagement with an electrical circuit, the two pins enabling the processor to determine the direction a plug has moved in the internal bore.

11. The system as in claim 10 wherein the two pins are spaced apart longitudinally to enable a passing plug to disengage one of the pins before engaging the other pin.

12. The system as in claim 10 wherein the two pins are out of phase with each other along the internal bore.

13. The system as in claim 8 wherein the time between the processor determining the pre-set number of plugs have been counted and the triggering of the first hydraulic event is programmable.

14. A method for activating a hydraulic valve in a completion string having a plurality of tubular hydraulic valves (THV) as in claim 1 and corresponding packer elements incorporated therein, comprising the steps of:

a) pressurizing the completion string to a first pressure to set the packer elements within the well;

b) increasing the pressure within the completion string to a second pressure level sufficient to effect rupture of a first shear pin within a THV;

c) dropping a plug into the completion string, the plug for successive engagement with plug counting systems within each THV and wherein if engagement of a plug with a THV triggers a first hydraulic event, the first shear pin ruptures to effect plug capture within the THV and valve opening; and d) increasing the pressure within the completion string to a third pressure level to effect well fracturing.

15. A method as in claim 14 wherein each of steps b) d) are repeated for each THV within the completion string.

16. A method as in claim 14 wherein each of the first, second and third pressure levels are 1500-2500 psi, 2500-4000 psi and 4000-10000 respectively.

17. A method for activating a hydraulic valve in a completion string having a plurality of tubular hydraulic valves (THV) as in claim 1 comprising the steps of:

a) increasing the pressure within the completion string to a first pressure level sufficient to effect opening of a lower hydraulic valve within the completion string;

b) increasing the pressure within the completion string to a second pressure level sufficient to effect rupture of a first shear pin within a THV;

c) dropping a plug into the completion string, the plug for successive engagement with plug counting systems within each THV and wherein if engagement of a plug with a THV triggers a first hydraulic event, the first shear pin ruptures to effect plug capture within the THV and valve opening; and d) increasing the pressure within the completion string to a third pressure level to effect well fracturing.

18. A tubular hydraulic valve system for connection to a tubing string to isolate a zone of interest within a well, to access a downhole formation for fracturing the zone of interest and for hydrocarbon production, the tubular hydraulic valve system comprising:

an outer sleeve having uphole and downhole connectors for attaching the tubular hydraulic valve system to a tubing string, the outer sleeve containing:

a plug counting system within the outer sleeve, the plug counting system comprising:

at least one plug interaction surface for detecting the movement of a plug past the plug counting system; and a hydraulic activation system operable to activate a plug grab system when a pre-set number of plugs have moved past the plug counting system;

wherein the hydraulic activation system is configured to communicate internal hydraulic pressure through one or more hydraulic channels, said communication of internal hydraulic pressure causing the downhole movement of a seat piston, such that the same plug that corresponds to the pre-set number of plugs is also retained by the plug grab system;

wherein the plug grab system is operatively connected to the plug counting system and comprises the seat piston, such that said downhole movement activates a collet ball seat with fingers configured to retain a plug within the plug grab system and seal the downhole section of the tubing string from the uphole section of the tubing string at the plug; and a valve system operatively connected to the plug grab system, the valve system including a valve operatively connected to at least one opening in the outer sleeve and wherein the valve system is responsive to a hydraulic fluid pressure to open the valve when a plug is retained in the plug grab system.

* * * * *